US009045719B1

(12) United States Patent
Kaur et al.

(10) Patent No.: US 9,045,719 B1
(45) Date of Patent: Jun. 2, 2015

(54) HYPOHALITE COMPOSITIONS COMPRISING A DIALLYL DIMETHYL AMMONIUM CHLORIDE POLYMER

(71) Applicant: The Clorox Company, Oakland, CA (US)

(72) Inventors: Sukhvinder Kaur, Oakland, CA (US); Terutaka T. Kitagawa, Pleasanton, CA (US); David R. Scheuing, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 14/571,122

(22) Filed: Dec. 15, 2014

Related U.S. Application Data

(63) Continuation of application No. 14/456,420, filed on Aug. 11, 2014.

(51) Int. Cl.

| | |
|---|---|
| ***C11D 3/24*** | (2006.01) |
| ***C11D 3/395*** | (2006.01) |
| ***C11D 3/48*** | (2006.01) |
| ***C11D 7/28*** | (2006.01) |
| ***C11D 9/28*** | (2006.01) |
| ***C11D 1/62*** | (2006.01) |

(52) U.S. Cl.
CPC ..... *C11D 3/3953* (2013.01); *C11D 1/62* (2013.01)

(58) Field of Classification Search
CPC ..... C11D 3/24; C11D 3/367; C11D 3/395; C11D 3/3951; C11D 3/3956; C11D 3/48; C11D 7/28; C11D 9/225; C11D 9/28
See application file for complete search history.

(56) References Cited

U.S. PATENT DOCUMENTS

| | | | |
|---|---|---|---|
| 3,896,056 | A | 7/1975 | Benjamin et al. |
| 4,147,649 | A | 4/1979 | Arnau et al. |
| 4,301,067 | A | 11/1981 | Koshugi |
| 4,501,834 | A | 2/1985 | Su |
| 4,501,835 | A | 2/1985 | Berke |
| 4,681,696 | A | 7/1987 | Bruegge |
| 4,710,374 | A | 12/1987 | Grollier et al. |
| 4,999,386 | A | 3/1991 | Oakes et al. |
| 5,049,383 | A | 9/1991 | Huth et al. |
| 5,158,766 | A | 10/1992 | Greenwald et al. |
| 5,578,598 | A | 11/1996 | Abe et al. |
| 5,700,559 | A | 12/1997 | Sheu et al. |
| 5,858,938 | A | 1/1999 | Glenn, Jr. et al. |
| 5,874,524 | A | 2/1999 | Pakusch et al. |
| 6,017,561 | A | 1/2000 | Zhou et al. |
| 6,028,043 | A | 2/2000 | Glenn, Jr. et al. |
| 6,221,399 | B1 | 4/2001 | Rolfes et al. |
| 6,270,754 | B1 | 8/2001 | Zhou et al. |
| 6,638,918 | B2 | 10/2003 | Davison et al. |
| 6,703,358 | B1 | 3/2004 | Aubay et al. |
| 6,743,775 | B2 | 6/2004 | Santar et al. |
| 6,838,078 | B2 | 1/2005 | Wang et al. |
| 6,849,586 | B2 | 2/2005 | Avery et al. |
| 6,887,564 | B2 | 5/2005 | Gagliardini et al. |
| 6,939,554 | B2 | 9/2005 | McDonald et al. |
| 7,018,709 | B2 | 3/2006 | Stevenson et al. |
| 7,141,617 | B2 | 11/2006 | Gratson et al. |
| 7,288,514 | B2 | 10/2007 | Scheuing et al. |
| 7,511,008 | B2 | 3/2009 | Scheuing et al. |
| 2001/0003221 | A1 | 6/2001 | Akbarian et al. |
| 2001/0056058 | A1 | 12/2001 | Panandiker et al. |
| 2002/0010105 | A1 | 1/2002 | Bacon et al. |
| 2002/0010124 | A1 | 1/2002 | Creeth et al. |
| 2002/0049149 | A1 | 4/2002 | Durbut et al. |
| 2002/0082181 | A1 | 6/2002 | Humphrey |
| 2002/0151454 | A1 | 10/2002 | Kischkel |
| 2002/0169097 | A1 | 11/2002 | Kasturi et al. |
| 2003/0059398 | A1 | 3/2003 | Ranger et al. |
| 2003/0114342 | A1 | 6/2003 | Hall |
| 2003/0147826 | A1 | 8/2003 | Anthony et al. |
| 2003/0176306 | A1 | 9/2003 | McKechnie |
| 2003/0216281 | A1 | 11/2003 | DeLeo et al. |
| 2003/0228992 | A1 | 12/2003 | Smets et al. |
| 2004/0013638 | A1 | 1/2004 | Aubay et al. |
| 2004/0052748 | A1 | 3/2004 | Vondruska |
| 2004/0103483 | A1 | 6/2004 | Delplancke et al. |
| 2004/0152617 | A1 | 8/2004 | Murphy et al. |
| 2004/0170587 | A1 | 9/2004 | Vondruska |

(Continued)

FOREIGN PATENT DOCUMENTS

| | | | |
|---|---|---|---|
| EP | 0342997 | B2 | 5/1989 |
| WO | 01/23511 | A1 | 4/2001 |

(Continued)

OTHER PUBLICATIONS

Stuart et al. Colloids & Surfaces 242 (2004) 167-174.
Stuart et al. Langmuir 2004 (20) 1073-1084.
Tiller European Coatings Journal-Biocides-12 (06) 28-32.
Buchhammer et al. Colloids & Surfaces 122 (1997) 1-12.
Buchhammer et al. Colloids & Surfaces 137 (1998) 45-56.
Buchhammer et al. Colloids & Surfaces 140 (1998) 377-384.
Buchhammer et al. Colloids & Surfaces 218 (2003) 151-159.
Buchhammer et al. Colloid Polym Sci 278 (2000) 841-847.
International Search Report of PCT Application No. PCT/US 2011/29530, May 27, 2011, 3 Pages.
International Search Report of PCT Application No. PCT/US 2011/29459, Jun. 3, 2011, 4 Pages.
Stefan van der Burgh et al; "Complex coacervation core micelles as anti-fouling agents on silica and polystyrene surfaces"; Elsevier; Colloids and Surfaces A: Physiochem.Eng. Aspects 242 (2004); pp. 167-174; www.elsevier.com.

(Continued)

*Primary Examiner* — Charles Boyer
(74) *Attorney, Agent, or Firm* — Alok Goel

(57) ABSTRACT

The invention relates to compositions and methods of treatment employing compositions including a cationic polyelectrolyte, without any anionic polyelectrolytes, so that no polyelectrolyte complex (PEC) is formed. In addition to not forming PECs, and being free of anionic water-soluble polymers (i.e., an anionic polyelectrolyte polymer that could form a PEC with the cationic polyelectrolyte), the composition is also free of random copolymers, block copolymers, coacervates, precipitates, and silicone copolymers. The composition may be a concentrate, to be diluted prior to use to treat a surface.

18 Claims, 1 Drawing Sheet

(56) References Cited

U.S. PATENT DOCUMENTS

| | | | | |
|---|---|---|---|---|
| 2004/0194800 | A1 | 10/2004 | Chang et al. | |
| 2005/0008534 | A1 | 1/2005 | Hodge et al. | |
| 2005/0009971 | A1 | 1/2005 | Hodge et al. | |
| 2005/0013794 | A1 | 1/2005 | Hodge et al. | |
| 2005/0014670 | A1 | 1/2005 | Hodge et al. | |
| 2005/0026801 | A1 | 2/2005 | Broeckx et al. | |
| 2005/0096239 | A1 | 5/2005 | Barnabas et al. | |
| 2005/0154361 | A1 | 7/2005 | Sabesan | |
| 2005/0159321 | A1 | 7/2005 | Cusack et al. | |
| 2005/0182021 | A1 | 8/2005 | Nichols et al. | |
| 2005/0204477 | A1 | 9/2005 | Casella et al. | |
| 2005/0233938 | A1 | 10/2005 | Delplancke et al. | |
| 2006/0035805 | A1 | 2/2006 | Penninger | |
| 2006/0035807 | A1 | 2/2006 | Kasturi et al. | |
| 2006/0058214 | A1 | 3/2006 | Zhang et al. | |
| 2006/0073994 | A1 | 4/2006 | Hage | |
| 2006/0074005 | A1* | 4/2006 | Kischkel et al. | 510/504 |
| 2006/0275337 | A1 | 12/2006 | Cohen Stuart et al. | |
| 2006/0276371 | A1 | 12/2006 | Schreiner et al. | |
| 2007/0054828 | A1 | 3/2007 | Gentschev et al. | |
| 2007/0259800 | A1 | 11/2007 | Boutique et al. | |
| 2007/0293414 | A1 | 12/2007 | Panandiker et al. | |
| 2008/0108537 | A1 | 5/2008 | Rees | |
| 2010/0237282 | A1* | 9/2010 | Komatsu et al. | 252/187.25 |
| 2010/0316715 | A1 | 12/2010 | Andersson | |
| 2011/0236450 | A1 | 9/2011 | Scheuing | |
| 2011/0236582 | A1 | 9/2011 | Scheuing | |
| 2013/0216631 | A1 | 8/2013 | Garner et al. | |
| 2014/0120056 | A1* | 5/2014 | Scheuing et al. | 424/78.27 |

FOREIGN PATENT DOCUMENTS

| | | | |
|---|---|---|---|
| WO | 2003/068843 | A1 | 8/2003 |
| WO | 2004/041986 | A1 | 5/2004 |
| WO | 2005/044967 | A3 | 5/2005 |
| WO | 2005/072712 | A3 | 8/2005 |
| WO | 2005/092273 | A3 | 10/2005 |
| WO | 2007009917 | A1 | 1/2007 |
| WO | 2007/022235 | A1 | 2/2007 |
| WO | 2008/134212 | A1 | 11/2008 |

OTHER PUBLICATIONS

Chua (Wal-Mart to Sell Only Concentrated Laundry Detergent Category by 2008, Jasmin Malik Chua, Oct. 1, 2007, http: //www.treehuggercom/corporate-responsibility/wal-mart-to-sell-only-concentrated-laundry-detergent-categoryby-2008.html, Retrieved Jun. 12, 2013).

Dautzenberg (Dautzenberg, H., Polyelectrolyte Complex Formation in Highly Aggregating Systems, 1, Effect of Salt: Polyelectrolyte Complex Formation in the Presence of NaCI, Macromolecules 1997, 30, 7810-7815).

Zintchenko et al., Polyelectrolyte Complex Formation with Double Hydrophilic Block Polyelectrolytes: Effects of the Amount and Length of the Neutral Block, Langmuir 2002, 18, 1386-1393.

Kitchen Clean-Up, EC 1552-E, Oregon State University Extension Service, Published Sep. 2002.

US Non-Final Rejection, dated Jun. 26, 2013, from U.S. Appl. No. 13/046385, filed Mar. 11, 2011.

US Final Rejection, dated Oct. 22, 2013, from U.S Appl. No. 13/046,385, filed Mar. 11, 2011.

US Non-Final Rejection, dated Jul. 12, 2013, from U.S. Appl. No. 13/772,674, filed Feb. 21, 2013.

US Final Rejection, dated Oct. 31, 2013, from U.S. Appl. No. 13/772,674, filed Feb. 21, 2013.

US Non-Final Rejection, dated Aug. 8, 2014, from U.S. Appl. No. 13/772,674, filed Feb. 21, 2013.

US Non-Final Rejection, dated Aug. 4, 2014, from U.S. Appl. No. 14/227,272, filed Mar. 27, 2014.

US Non-Final Rejection, dated Aug. 13, 2014, from U.S. Appl. No. 14/277,363, filed Mar. 27, 2014.

US Final Rejection, dated Jan. 29, 2015, from U.S. Appl. No. 13/772,674, filed Feb. 21, 2013.

International Search Report of PCT Application No. PCT/US 2014/50577, Aug. 11, 2014, 4 Pages.

* cited by examiner

HYPOHALITE COMPOSITIONS COMPRISING A DIALLYL DIMETHYL AMMONIUM CHLORIDE POLYMER

CROSS-REFERENCE TO RELATED APPLICATIONS

This application is a continuation of co-pending U.S. Patent Application entitled "HYPOHALITE COMPOSITIONS COMPRISING A CATIONIC POLYMER", application Ser. No. 14/456,420, filed Aug. 11, 2014, the disclosure of which is hereby incorporated by reference in its entirety.

BACKGROUND OF THE INVENTION

1. The Field of the Invention

The present invention relates to sodium hypochlorite and other hypohalite or hypohalous acid compositions (e.g., aqueous solutions) that include a cationic polymer, as well as methods of making and using such compositions.

2. Description of Related Art

Consumers recognize sodium hypochlorite as a highly effective cleaning, bleaching and sanitizing agent that can be widely used in cleaning and sanitizing various hard and soft surfaces, in laundry care, etc. Often, sodium hypochlorite solutions in a relatively concentrated form are delivered to the consumer, who then dilutes them. A wide variety of automated washing machines which can control the addition of sodium hypochlorite to laundry washwater are also available. When used in washing machines, the sodium hypochlorite solution will typically come in contact with the detergent being used in the laundering process. Complex interactions between sodium hypochlorite and components of the detergent, such as surfactants, builders, enzymes, fragrances, dyes, fabric brighteners, fabric softener components, and anti-redeposition polymers and fabric care polymers can occur, and are thought to result in some cases in a reduction in the stain removal and bleaching performance of sodium hypochlorite, or reduction in the aesthetics or detergency performance of the detergent formulation used. Such complex interactions are commonly observed when the stain removal and whitening performance of sodium hypochlorite solutions is measured in the presence of different detergent formulations, whereby some detergent formulations are more compatible with the sodium hypochlorite solution than others. For example, fabric brighteners are often less effective or ineffective when contacted with the bleaching agent of the bleach solution.

In the case of manual washing of laundry, where sodium hypochlorite is employed, the relative volume of water to fabrics may be reduced, and hence the levels of suspended soils, both particulate and oily, may be significantly higher than in an automatic washing machine.

Sodium hypochlorite solutions designed to be diluted in such laundering processes may contain a variety of adjuvants to enhance the stability of the hypochlorite or enhance the aesthetics of use of the product (e.g., lower odor). Fragrances, hydrotropic materials (e.g., such as sodium xylene sulfonates), buffers, certain electrolytes (e.g., alkali metal halides, etc.) may be added to hypohalite solutions for such purposes.

However, variation in the overall consumer-perceivable fabric whitening and stain removal still exists when hypohalite solutions are used in combination with commercial detergent formulations. Thus, there continues to be a need for liquid compositions including hypohalite species, which compositions would exhibit improved or more consistent cleaning, bleaching, and whitening performance when used with various modern detergent formulations, or when used under conditions of high loads of suspended soils.

BRIEF SUMMARY OF THE INVENTION

In one aspect, the present invention is directed to a composition consisting of: (a) a homopolymer of diallyl dimethyl ammonium chloride (DADMAC); (b) an oxidant selected from the group consisting of a hypohalous acid, a hypohalite, and mixtures thereof; (c) water; and (d) optionally, a fragrance, a hydrotrope, a colorant, a dye, a buffer, a chelating agent, a surfactant, an electrolyte, an anti-microbial agent, a solvent, a stain and soil repellent, a lubricant, an odor control agent, a perfume, a fragrance release agent, an acid, a base, a solubilizing material, a stabilizer, an anti-corrosion agent, a thickener, a defoamer, a cloud-point modifier, a preservative, a water immiscible solvent, an enzyme, and mixtures thereof. The composition is free of anionic water-soluble polymers, random copolymers, block copolymers, coacervates, precipitates, and silicone copolymers. In addition, the composition does not form a polyelectrolyte complex (e.g., because no anionic water-soluble polymers are present, which might otherwise form a polyelectrolyte complex with the cationic poly (DADMAC) homopolymer.

Another embodiment of the present invention is directed to a composition consisting essentially of: (a) a homopolymer of diallyl dimethyl ammonium chloride (DADMAC); (b) an oxidant selected from the group consisting of a hypohalous acid, a hypohalite, and mixtures thereof; (c) water; and (d) optionally, a fragrance, a hydrotrope, a colorant, a dye, a buffer, a chelating agent, a surfactant, an electrolyte, an anti-microbial agent, a solvent, a stain and soil repellent, a lubricant, an odor control agent, a perfume, a fragrance release agent, an acid, a base, a solubilizing material, a stabilizer, an anti-corrosion agent, a thickener, a defoamer, a cloud-point modifier, a preservative, a water immiscible solvent, an enzyme, or mixtures thereof. The composition is free of anionic water-soluble polymers, random copolymers, block copolymers, coacervates, precipitates, and silicone copolymers. The composition does not form a polyelectrolyte complex (e.g., because no anionic water-soluble polymers are present).

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1A:
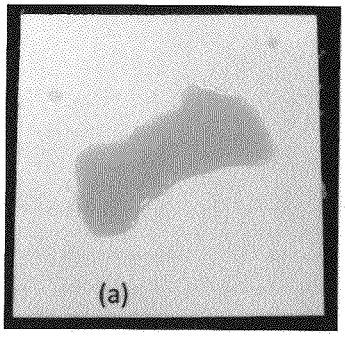
FIGS. 1A-1C show photographs of test results described in Example 4, showing wetting of acrylic tiles 30 seconds after application of diluted hypochlorite compositions including no poly(DADMAC), 20 mM of poly(DADMAC), and 50 mM of poly(DADMAC), respectively.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim. Where an ingredient, element, or step may or may not be included in a claim employing the closed "consisting of" transitional phrase, those elements, steps, or ingredients will be described as optional. Thus, the scope of the claim may allow for such specifically listed optional elements, steps, or ingredients, but not necessarily require them.

It must be noted that, as used in this specification and the appended claims, the singular forms "a," "an" and "the" include plural referents unless the content clearly dictates otherwise. Thus, for example, reference to a "surfactant" includes one, two or more such surfactants.

The term water-soluble polymer as used herein means a polymer which gives an optically clear solution free of precipitates at a concentration of 0.001 grams per 100 grams of water, preferably 0.01 grams/100 grams of water, more preferably 0.1 grams/100 grams of water, and even more preferably 1 gram or more per 100 grams of water, at 25° C.

As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." The term "disinfect" may generally refer to the elimination of many or all pathogenic microorganisms on surfaces with the exception of bacterial endospores. The term "sterilize" may refer to the complete elimination or destruction of all forms of microbial life and which is authorized under the applicable regulatory laws to make legal claims as a "sterilant" or to have sterilizing properties or qualities.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("wt %'s") are in wt % (based on 100 weight % active) of the particular material present in the referenced composition, any remaining percentage being water or an aqueous carrier sufficient to account for 100% of the composition, unless otherwise noted. For very low weight percentages, the term "ppm" corresponding to parts per million on a weight/weight basis may be used, noting that 1.0% by weight corresponds to 10,000 ppm.

II. Introduction

Hypohalite (e.g., hypochlorite) or hypohalous acid solutions provide significant whitening benefit on fabrics by breaking down light absorbing soils, resulting in an increased fabric reflectance (i.e., making them appear brighter and whiter). However, yellowing of fabric with age still results from unremoved, accumulated soils, and there remains a need for further improved brightening and whitening. In addition, such bleaching agents often exhibit poor compatibility with fluorescent whitening agents (FWAs) included in various detergent compositions. For example, upon mixing of the bleach composition with a detergent composition including a FWA, the brightening effect of the FWA is largely if not completely lost. The interaction of cationic polyelectrolytes provided in the inventive compositions present in wash liquor with FWAs often present in detergents can enhance their deposition on the fabrics during the washing process, making bleach compositions including such cationic polyelectrolytes far more compatible with detergent compositions including FWAs than possible with bleach compositions not including the cationic polyelectrolyte.

FWAs absorb light in the UV spectrum and emit in the blue region of the visible spectrum, thereby enhancing the overall spectral radiance of the fabric. The combination of a bleach with the cationic polymer leads to enhanced whiteness of the fabric, resulting from the combination of enhanced reflectance due to improved soil removal and light emission by the FWA. Because of the addition of the cationic polymer, more consistent results are obtained, no matter the actual commercial laundry detergent employed, making the bleach composition more compatible across a wider spectrum of laundry detergents, particularly those including an FWA.

Applicants believe, without being bound by theory, that the presence of the cationic polyelectrolyte in the wash liquor provides an increased concentration of the hypochlorite ion at the surfaces of any stains or particulate components of stains bearing an anionic charge, thereby increasing the reaction rate of oxidation reactions. At the same time, the adsorption of the cationic polyelectrolyte onto particulates, such as clays and silica, particularly those of small particle size which may redeposit onto fabrics or in intra-fiber spaces of fabrics, results in the flocculation of these particles into larger ones which are then more efficiently isolated and removed by surfactants typically present in the detergent formulation.

A number of water-soluble cationic polyelectrolytes may be suitable for use in the inventive compositions. In an embodiment, the water-soluble cationic polyelectrolyte is a homopolymer of diallyl dimethyl ammonium chloride (DADMAC).

III. Suitable Cationic Polymers

As described above, a preferred cationic polyelectrolyte is poly(DADMAC), although other water-soluble cationic polyelectrolyte polymers may be suitable for use in some embodiments. The selection of the type of cationic polyelectrolyte and its concentration in the hypohalite or hypohalous acid solutions may be affected by the effect of the cationic polyelectrolyte on the stability of the hypohalite or hypochlorous acid upon storage. The relative storage stability of the solutions can be adjusted over a wide range (e.g., days to years) by adjusting the concentrations of the hypohalite or hypochlorous acid bleach component and the water-soluble cationic polyelectrolyte.

The water-soluble cationic polyelectrolytes are typically in soluble form prior to the mixing step so that they will form clear solutions in water at a concentration of at least 0.1 gram polymer/100 grams of water, at least 1 gram polymer/100 grams of water, at least 10 grams polymer/100 grams water, or more preferably in excess of 50 grams polymer/100 grams of water at 25° C. In the case of some polymers, an appropriate salt may be formed in order to achieve water solubility, and thus a pre-formed salt of the polymer in water may be used or a polymer may be dissolved in water containing an appropriate acid or base which forms the water-soluble salt of the polymer.

The cationic polyelectrolyte polymer is preferably a homopolymer. A homopolymer of diallyl dimethyl ammonium chloride (DADMAC) is preferred, and has been tested and found to be particularly suitable by the present inventors. In another embodiment, although perhaps less preferred, random or alternating copolymers including the DADMAC monomer may also be suitable for use. As described herein and claimed, in an embodiment, no copolymers (random or alternating) are employed, but the cationic polyelectrolyte is a homopolymer of DADMAC.

In embodiments, where it is desired to use copolymers, rather than the preferred homopolymer, the polymer may be linear or branched. Copolymers may be synthesized by processes expected to lead to statistically random, alternating, or so-called gradient type copolymers. In contrast, water-soluble block copolymers are not suitable for use, since these types of polymers may form aggregates or micelles, in which the more hydrophobic block(s) comprise the core of the aggregate or micelles and the more hydrophilic block(s) comprise a "corona" region in contact with water. It is believed that these self-assembly processes undesirably compete with the ability of the polyelectrolyte to interact with the molecule of interest. Such block copolymers do not provide the desired interaction with the fluorescent whitening agents (FWAs), which is a distinct advantage provided by the present compositions.

Although mixtures of water-soluble cationic polymers may be suitable for use in some embodiments, the mixtures selected should not comprise block copolymers capable of forming so-called "complex coacervate" micelles through self-assembly. When the polymers are copolymers (e.g., a random copolymer), the ratio of the two or more monomers may vary over a wide range, as long as water solubility of the polymer is maintained.

Diallyl dimethyl ammonium chloride is a preferred monomer for use in forming the cationic polyelectrolyte polymer. Examples of other possibly suitable cationic monomers that may be used include, but are not limited to quaternary ammonium salts of acrylamides, quaternized derivatives of acrylate esters and amides. Monomers capable of developing a cationic charge that may also prove possibly suitable include ethyleneimine and its derivatives, vinyl imidazole, and vinyl pyridine oxide. Combinations of any of the foregoing may also be used.

Additional suitable cationic polymers include homopolymers or random copolymers of monomers having a permanent cationic charge or monomers capable of forming a cationic charge in solution upon protonation. Diallyl dimethyl ammonium salts such as DADMAC are examples of permanently cationic monomers. Other permanently cationic monomers that may prove suitable include, but are not limited to quaternary ammonium salts of substituted acrylamide, methacrylamide, acrylate and methacrylate, such as trimethylammoniumethyl methacrylate, trimethylammoniumpropyl methacrylamide, trimethylammoniumethyl methacrylate, trimethylammoniumpropyl acrylamide, 2-vinyl N-alkyl quaternary pyridinium, 4-vinyl N-alkyl quaternary pyridinium, 4-vinylbenzyltrialkylammonium, 2-vinyl piperidinium, 4-vinyl piperidinium, 3-alkyl 1-vinyl imidazolium, and the ionene class of internal cationic monomers. The counterion of the cationic co-monomer can be selected from, for example, chloride, bromide, iodide, hydroxide, phosphate, sulfate, hydrosulfate, ethyl sulfate, methyl sulfate, formate, acetate, and combinations or mixtures thereof.

Examples of monomers that are cationic on protonation include, but are not limited to, acrylamide, N,N-dimethylacrylamide, N,N di-isopropylacryalmide, N-vinylimidazole, N-vinylpyrrolidone, vinyl pyridine N-oxide, ethyleneimine, dimethylaminohydroxypropyl diethylenetriamine, dimethylaminoethyl methacrylate, dimethylaminopropyl methacrylamide, dimethyl amino ethyl acrylate, dimethylaminopropyl acrylamide, 2-vinyl pyridine, 4-vinyl pyridine, 2-vinyl piperidine, 4-vinylpiperidine, vinyl amine, diallylamine, methyldiallylamine, vinyl oxazolidone, vinyl methyoxazolidone, and vinyl caprolactam.

Chitosan is a natural polymer capable of developing a cationic charge and exhibits acceptable solubility in water when it is dissolved in water containing an acid, such as citric or acetic acid. Thus, an acid may be present as an adjuvant in a chitosan solution used in the formation of a cationic polyelectrolyte solution based on chitosan polymer. The amount of acid required may be readily determined by the concentration of the chitosan desired, and by the appearance of the solution. Alternatively, a solid salt of chitosan, such as the pyrrolidone carboxylic acid salt of chitosan, may be dissolved directly in water and used.

Monomers that are cationic on protonation typically exhibit a positive charge over at least a portion of the pH range of 2-11. Copolymers of cationic polymers may in an embodiment also include other monomers, for example monomers having an uncharged hydrophilic or hydrophobic group. Suitable copolymers may include acrylamide, methacrylamide and substituted acrylamides and methacrylamides, acrylic and methacrylic acid and esters thereof. In some embodiments, amphoteric polymers having a net cationic charge may possibly be used. Such an amphoteric polymer may possibly include some anionic monomers in the backbone of the amphoteric polymer having a net cationic charge, although no copolymers having a net anionic charge are present. As described repeatedly above, a homopolymer of a cationic monomer (e.g., DADMAC) is preferred and most effective.

The cationic polymer level in the compositions of the present invention may typically range from about 0.001% by weight to about 5.0% by weight, or from about 0.01% by weight to about 2.5% by weight, or from about 0.01% by weight to about 1.0% by weight, or from about 0.1% by weight to about 0.50% by weight.

In an embodiment, no anionic monomers are employed. Examples of such excluded anionic monomers may include, but are not limited to, acrylic acid, methacrylic acid, crotonic acid, maleic acid, phthalic acid and its isomers (e.g., including acid-terminated polyesters or condensates of polyesters, polyurethanes or polyamides and ethylene, propylene or butylene oxide), sulfonate functional monomers such as acrylamidopropyl methane sulfonic acid (AMPS), and combinations thereof.

The present inventive compositions do not include block copolymers, as described above. The present compositions do not include block copolymers, because such block copolymers readily form complex coacervate micelles, sometimes referred to as polymeric micelles. Such structures are characterized by restriction of the charged groups of the polymer to the interior of the formed micelles. As a result, the charged groups are not disposed about the exterior surface, and are thus not available for interaction with FWAs, anionically charged soils on fabric surfaces, dispersed soils, dispersed micro-organisms, etc. Thus, at a minimum, such block copolymers tend to form structures which undesirably compete with or interfere with the desired adsorption of the water-soluble cationic polymer onto fabrics, surfaces, dispersed particulate soils or micro-organisms. This in turn interferes with the flocculation of dispersed particulate soils or micro-organisms, increased hypochlorite concentration at the surface of any stains or particulate components of stains bearing an anionic charge. As such, the present compositions do not include any such block copolymers, do not form coacervate micelles, or similar coacervate micelle complexes.

Stated more technically, block copolymers such as those forming complex coacervate micelles restrict charged groups to the core of the micelle, where the surrounding corona is formed of hydrophilic but neutral (uncharged) blocks. Without any charged groups on the exterior of the micelle, this prevents the possibility of interactions between exterior charged groups and any target charged components. Such interactions are not only possible, but are provided in the claimed compositions that are based instead on a non-crosslinked homopolymer of a cationic polyelectrolyte.

The present inventive compositions do not form complexes that result from the interaction between two oppositely charged polyelectrolyte polymers, either in a ready-to-use form or upon dilution. In other words, the present invention does not form polyelectrolyte complexes. The presently contemplated compositions do not include such an anionic polyelectrolyte polymer, so that no complex is formed. Rather, the present compositions rely on only the homopolymer of the cationic polyelectrolyte to provide the desired interaction with the target soil, micro-organisms, fluorescent whitening agent (FWA), etc. Because no anionic polyelectrolyte is included, it is believed that the efficiency of interaction between the cationic polyelectrolyte and the FWA included within the detergent formulation is increased. This has been found by the present inventors to provide excellent protection to the FWA from damage otherwise caused by the bleach component, making the bleach composition more compatible across a variety of commercially available detergent formulations (e.g., those including FWAs). Furthermore, because no anionic polyelectrolyte is present in the present bleach compositions, there is no risk of formation of large polyelectrolyte complexes which are further cross-linked with the FWA. Such interactions between the bleach composition components and the components of the detergent formulation may lead to undesirable precipitation of such complexes out of solution, causing reduced deposition of the FWA on the fabric (which is desired) during washing. As such, the presently described formulations do not include anionic polyelectrolyte polymers, and do not form polyelectrolyte complexes formed by attraction of oppositely charged polyelectrolyte polymers.

There are no particular restrictions on how the cationic polyelectrolyte polymer solution is prepared. Any agitation needed may depend on the viscosity of the components, and how readily they dissolve in water. Macroscopic aggregates due to precipitation of the polymer or its interaction with any other included components are to be avoided. The mechanical energy input may be limited to, and determined by, whatever input is needed to ensure complete dissolution of the polymer component, and not by any need for shear-induced destruction of any macroscopic colloidal aggregates (as none are to be formed). Thus, in many examples, the maximum practical concentration of the cationic polyelectrolyte may be limited by the solubility of the polyelectrolyte, or the viscosity of the resultant clear (or slightly tinted, but still clear, so as to be seen through), one phase solution, strictly for mechanical reasons. Tinting of the final solution may be provided by a dye or colorant adjuvant. In general, such solutions, in the absence of particulate adjuvants, will exhibit bulk viscosities less than about 1 million centipoise, preferably less than about 10,000 centipoise, more preferably less than about 1,000 centipoise.

Similarly, in the absence of adjuvants that could cause a hazy or milky appearance (e.g., resulting from light scattering within the composition), the composition may be clear (or slightly tinted, but still clear, so as to allow it to be seen through).

There are no particular restrictions on the molecular weight of the cationic polyelectrolyte, so long as it can be solubilized in the bleach solution.

IV. Solvents

The bleach solutions employ water as a solvent. In some embodiments, water is the only solvent. In other embodiments, additional water-miscible solvents such as lower alcohols, glycols, glycol ethers, glycol esters, dimethyl sulfoxide, dimethyl formamide, and the like may be employed. Water-immiscible solvents may also be employed, if desired. Further examples of possibly useful solvents include $C_1$-$C_6$ alkanols, $C_1$-$C_6$ diols, $C_1$-$C_{10}$ alkyl ethers of alkylene glycols, $C_3$-$C_{24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. In embodiments where solvents in addition to water are present, water may comprise at least 80% of the composition by weight, at least 90% of the composition by weight, or at least 95% of the composition by weight. In another embodiment of the invention, any organic solvents (e.g., water-miscible) can be present at a level of from 0.001% to 10%, or from 0.01% to 10%, or from 0.1% to 5% by weight, or from 1% to 2.5% by weight.

Other liquid materials, such as hydrocarbons, oils, etc. (e.g., included as a fragrance, perfume, or water-immiscible solvent), which are not necessarily miscible with water at a concentration of at least 1 gram liquid/100 grams of water at 25° C. may in some embodiments be included. Inclusion of such materials may be possible through the use of surfactants or the addition of certain water-miscible solvents serving as "coupling agents".

V. Oxidants

The compositions of the present invention include one or more oxidants (also known as bleaching agents) selected from the group consisting of hypohalous acid, hypohalite, and combinations thereof. Examples of hypohalous acids include hypochlorous acid, or another hypohalous acid where the chlorine is replaced with another halogen (e.g., bromine, fluorine, iodine, etc.). Examples of hypohalites include alkali metal salts of a hypohalous acid (e.g., hypochlorous acid), alkali earth metal salts of a hypohalous acid (e.g., hypochlorous acid), and combinations thereof. Examples of alkali metal salts of hypochlorous acid include sodium hypochlorite, potassium hypochlorite, and combinations thereof. Examples of alkali earth metal salts of hypochlorous acid include magnesium hypochlorite, calcium hypochlorite, and combinations thereof. Combinations of any of the above (e.g., an alkali metal salt of hypochlorous acid and an alkaline earth metal salt of hypochlorous acid) may be used. In some embodiments, it may be possible to use other oxidants, such as, but not limited to, hydrogen peroxide, solubilized chlorine, any source of free chlorine, solubilized chlorine dioxide, acidic sodium chlorite, active chlorine generating compounds, active oxygen generating compounds, chlorine-dioxide generating compounds, solubilized ozone, sodium potassium peroxysulfate, sodium perborate, and combinations thereof. The oxidant can be present at a level of from 0.001% to 10%, or from 1% to 10%, or from 3% to 8.5% by weight.

VI. Adjuvants

As described above, various select adjuvants may be included within the formulation, such as a fragrance, a hydrotrope, a colorant, a dye, a buffer, a chelating agent, a surfactant, an electrolyte, an anti-microbial agent, a solvent, a stain and soil repellent, a lubricant, an odor control agent, a perfume, a fragrance release agent, an acid, a base, a solubilizing material, a stabilizer, an anti-corrosion agent, a thickener, a defoamer, a cloud-point modifier, a preservative, a water immiscible solvent, an enzyme, and mixtures thereof. Some such acceptable and optional adjuvants are discussed below.

A. Buffers, Acids, Bases & Electrolytes

Buffers, also known as pH adjusting agents, may include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. In one embodiment, preferred buffering agents include but are not limited to: dicarboxylic acids, such as, succinic acid and glutaric acid. Some suitable nitrogen-containing buffering agents are amino acids such as lysine or lower alcohol amines like mono-, di-, and tri-ethanolamine. Other nitrogen-containing buffering agents are tri(hydroxymethyl) amino methane $(HOCH_2)_3CNH_3$ (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris(hydroxymethyl)methyl glycine (tricine). Other suitable buffers may include ammonium carbamate, citric acid, and acetic acid. Mixtures of any of the above may also be acceptable. Useful inorganic buffers/alkalinity sources may include ammonia, the alkali metal carbonates and alkali metal phosphates, e.g., sodium carbonate, sodium polyphosphate.

When a hypohalous acid (e.g., hypochlorous acid) is used, an acid may be beneficial to stabilize the pH and maintain the desired ratio of hypochlorous acid to hypochlorite anion. In some cases, the acid may be added to a solution containing hypochlorite anion to convert this anion to hypochlorous acid. An acid may also be used to control the formation of chlorine dioxide from a chlorite salt. Acid may also be used with peroxygen compounds to control stability or reactivity. Acids may also be added for cleaning and removal of soils such as hard water deposits and rust. Exemplary acids include, but are not limited to inorganic acids such as hydrochloric acid or sulfuric acid, and organic acids such as sulfonic acid, monocarboxylic acid, dicarboxylic acid, acid sulfate, acid phosphate, phosphonic acid, aminocarboxylic acid, and mixtures thereof. Specific examples of acids, include but are not limited to, acetic acid, succinic acid, glutaric acid, adipic acid, sodium bisulfate, 3-pyridine sulfonic acid, dodecyl benzene sulfonic acid, and mixtures thereof. Sodium, potassium and any other salt of any of these acids or mixtures thereof may also be included to achieve the desired pH and create a buffer system that resists changes in pH.

When used herein, the buffer, acid, base, or electrolyte salt is preferably present at a concentration of from about 0.001% by weight to about 20% by weight, more preferably 0.05% by weight to about 1% by weight, even more preferably from about 0.05% by weight to about 0.5% by weight, and most preferably 0.1% by weight to about 0.5% by weight.

An electrolyte may be an organic acid or base, inorganic acid or base, their water-soluble salts, or combinations thereof. An electrolyte, buffer, acid, or base may be deemed appropriate when its use is indifferent to, or known to be compatible with, the bleach component, the cationic polyelectrolyte polymer, and any other adjuvants which may be present in the final solution.

B. Surfactants

The compositions of the present invention may optionally include one or more surfactants selected from nonionic, anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of possibly suitable cationic surfactants is given in U.S. Pat. No. 4,259,217 to Murphy. If present, any surfactants may be present at a level of from about 0% by weight to 90% by weight, or from about 0.001% by weight to 50% by weight, or from about 0.01% by weight to 25% by weight. Alternatively, surfactants may be present at a level of from about 0.1% by weight to 10% by weight, or from about 0.1% by weight to 5% by weight, or from about 0.1% by weight to 1% by weight.

C. Additional Adjuvants

The compositions of the present invention may optionally contain one or more of the following additional adjuvants: a fragrance, a hydrotrope, a colorant, a dye, a chelating agent, a solvent, a stain and soil repellent, a lubricant, an odor control agent, a perfume, a fragrance release agent, a solubilizing material, a stabilizer, an anti-corrosion agent, a thickener, a defoamer, a cloud-point modifier, a preservative, a water immiscible solvent, or an enzyme.

The compositions of the present invention may be used by distributing, e.g., by placing the aqueous solution into a dispensing means, preferably a spray dispenser and spraying an effective amount onto the desired surface or article. An effective amount as defined herein means an amount sufficient to modify the surface of the article to achieve the desired benefit, for example, but not limited to, soil repellency, cleaning and/or disinfectancy. Distribution can be achieved by using a spray device, such as a trigger sprayer or aerosol container, or by other means including, but not limited to a roller, a pad, a wipe or wiping implement, sponge, etc.

The compositions may also be used by simply adding the composition to wash water (e.g., in a washing machine, for example, to which a detergent formulation is also added). For example, a surface, an article or a device may be treated with the compositions of the present invention by immersing them or exposing the desired portion of the article or device to be treated to a bulk liquid treatment composition (e.g., wash water in a washing machine) containing the described cationic polyelectrolyte. Suitable immersion methods include baths, dipping tanks, wet padding and wet rolling application means common to the art. Such means are also suitable for forming premoistened wipes wherein a carrier substrate such as a woven material (cloth, towel, etc.) or a non-woven material (paper towel, tissue, toilet tissue, bandage) may be dipped, impregnated, or padded with the described cationic polyelectrolyte compositions.

VII. Examples

Example 1

Compositions of Sodium Hypochlorite Solutions Containing Poly(DiallylDimethyl Ammonium Chloride) (DADMAC)

The aqueous compositions described in the present application can be prepared by mixing the ingredients together. An example composition is shown in Table 1. No particular order of mixing is required, although the caustic is typically added last in order to adjust pH to a final range of 11.6-12.2. A typical preparation is described as follows for a hypochlorite solution containing 50 mM of poly(DADMAC) (concentration based on moles of one charged monomeric unit). To a beaker containing 83.55 grams of water was added 191.7 grams of 12.9% sodium hypochlorite solution. 24.14 grams of 10% poly(DADMAC) was added to this solution while stirring. Sodium hydroxide (50%) was added until the pH of the solution reached a target of 11.6-12.2. Water was added to balance.

TABLE 1

Example composition of the bleach product with varying poly(DADMAC) concentrations:

| No. | Poly (DADMAC) (wt %) | Sodium Hypochlorite (wt %) | Poly(DADMAC) concentration* (mM) | Sodium Hydroxide | pH | Phase stability |
|---|---|---|---|---|---|---|
| 1 | 0.0805% | 8.25% | 5 | 0.02% | 11.91 | Clear |
| 2 | 0.161% | 8.25% | 10 | 0.04% | 11.94 | Clear |
| 3 | 0.322% | 8.25% | 20 | 0.052% | 11.9 | Clear |
| 4 | 0.805% | 8.25% | 50 | 0.13% | 11.94 | Clear |
| 5 | 1.047% | 8.25% | 65 | 0.16% | 11.97 | Clear |
| 6 | 1.61% | 8.25% | 100 | 0.21% | 11.92 | Clear |
| 7 | 2.093% | 8.25% | 130 | 0.27% | 11.91 | Clear |

*calculated as millimoles of cationic monomeric units.

TABLE 2

Example composition of the bleach product with varying hypochlorite concentrations:

| No. | Poly (DADMAC) (wt %) | Sodium Hypochlorite (wt %) | Poly(DADMAC) concentration* (mM) | Sodium Hydroxide | pH | Phase stability |
|---|---|---|---|---|---|---|
| 8 | 0.0805% | 0.5% | 5 | 0.2% | 12.1 | Clear |
| 9 | 0.322% | 1.8% | 20 | 0.04% | 12.05 | Clear |

TABLE 2-continued

Example composition of the bleach product with varying hypochlorite concentrations:

| No. | Poly (DADMAC) (wt %) | Sodium Hypochlorite (wt %) | Poly(DADMAC) concentration* (mM) | Sodium Hydroxide | pH | Phase stability |
|---|---|---|---|---|---|---|
| 10 | 0.322% | 2.4% | 20 | 0.052% | 12.1 | Clear |
| 11 | 0.805% | 4.0% | 50 | 0.13% | 12.2 | Clear |
| 12 | 0.322% | 6.6% | 20 | 0.16% | 11.91 | Clear |
| 13 | 1.047% | 4.13% | 65 | 0.21% | 12.23 | Clear |
| 14 | 0.322% | 10.5% | 20 | 0.27% | 12.1 | Clear |

*calculated as millimoles of cationic monomeric units

Example 2

Stability of Sodium Hypochlorite Compositions Containing Poly(DADMAC)

TABLE 3

Hypochlorite degradation profiles of formulations with poly(DADMAC) after prolonged storage at 49° C.

| Concentration of poly(DADMAC) (mM) | % Hypochlorite Remaining | | | | | |
|---|---|---|---|---|---|---|
| | 0 days | 4 days | 6 days | 10 days | 12 days | 14 days |
| 0 | 100% | 93.63% | 91.79% | 81.00% | 81.74% | 75.74% |
| 5 | 100% | 91.42% | 90.81% | 81.62% | 80.27% | 75.37% |
| 10 | 100% | 90.69% | 89.46% | 82.11% | 80.39% | 75.98% |
| 20 | 100% | 91.91% | 89.46% | 83.09% | 81.62% | 75.00% |

As shown in Table 3, the hypochlorite degradation in formulations containing poly(DADMAC) is similar to the formulation without the polymer at elevated temperature, showing that the stability of hypochlorite is not appreciably affected by the presence of poly(DADMAC) at these levels.

Example 3

Whiteness Enhancement of Laundered Fabrics—Fading of Fabrics with Sunlight and Weatherometer Photographs Depicting the Need for Brightening with Bleach Testing was conducted to assess the whitening performance of product when used in a laundry wash experiment. Each set of tests were performed with Tide® detergent with Acti-Lift and traditional deep-fill top loader washing machines using the industry standard test method ASTM D4265. This testing measured the ability of each product to enhance whitening. Unbrightened cotton fabric and a cotton terry cloth fabric (Testfabrics, Inc.) were tested for brightener deposition. A set number of replicates were washed according to specifications and conditions recommended in the ASTM D 4265 method.

Whiteness was measured with a Konica Minolta CM-3600A spectrophotometer and delta W was calculated using the CIE 2000 color difference formula. The data was analyzed to determine the statistical difference between of each of the respective products.

The standard dose of ½ cup of bleach solution was used for each experiment in conjunction with a dose of Tide® detergent.

TABLE 4

| Improvement in delta W with increasing poly(DADMAC) concentration | | |
|---|---|---|
| Concentration of poly(DADMAC) | Delta W | |
| (mM) | Cotton Flag | Terry Cloth |
| 0 | 6.33 | 13.02 |
| 5 | 6.09 | 13.08 |
| 20 | 10.85 | 18.99 |
| 50 | 14.99 | 23.17 |
| 100 | 17.29 | 26.60 |

As can be seen in Table 4, increasing concentration of poly(DADMAC) leads to enhancement of whiteness (i.e., increased delta W) on both fabrics. Since the enhancement or increase of delta W is more than 10 units at concentrations of poly(DADMAC) above 20 mM, the enhanced whiteness of the fabric can be easily observed under natural sunlight conditions. It can also be deduced that the brightener deposition will continue to increase as a fabric is washed multiple times and the whiteness will continue to improve during the lifetime of the worn fabric.

Example 4

Wetting Enhancement of Hard Surfaces

Testing was conducted to assess the wetting of hard surfaces by diluted hypochlorite formulations. Each test formula was diluted with water in a 1:30 ratio by weight. The diluted sample was dyed pink with a small amount of dye to facilitate visual observation of wetting. 1 mL of each diluted sample was placed on a white acrylic tile or 0.5 mL of each diluted samples was placed on a glass slide. The liquid was smeared to cover the entire surface and the resulting wetting was visually characterized by observing the surface area covered by the liquid.

Figure 1B:
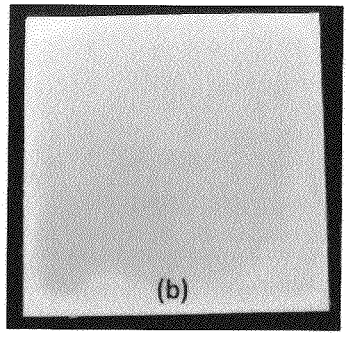
Figure 1C:
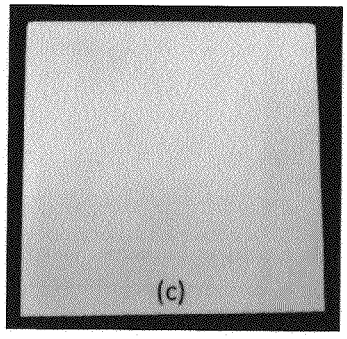
Figure 2A:
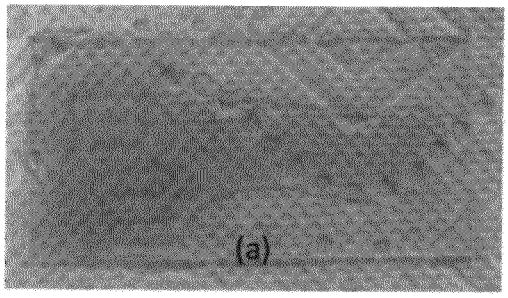
FIGS. 2A-2C show photographs of test results also described in Example 4, showing wetting of glass slides 30 seconds after application of diluted hypochlorite compositions including no poly(DADMAC), 20 mM of poly(DADMAC), and 50 mM of poly(DADMAC), respectively.

As shown in FIGS. 1A and 2A, a hypochlorite solution by itself does not effectively wet an acrylic tile or a glass slide, respectively. Rather, the liquid compositions tends to pool together. In contrast, when poly(DADMAC) is included in the formulation, the wetting is markedly improved as seen by the increased or enhanced coverage of the tile surface (FIGS. 1B and 1C). In each of FIGS. 1A-1C, the acrylic tile is shown 30 seconds after application of the diluted 8.25% by weight hypochlorite formulation including no poly(DADMAC) (FIG. 1A), 20 mM poly(DADMAC) (FIG. 1B), and 50 mM poly(DADMAC) (FIG. 1C), respectively. The formulations tested in FIGS. 1B and 1C consisted of the poly(DADMAC), the sodium hypochlorite oxidant, sodium hydroxide, water, and the pink dye added for purposes of better visualization. The improved wetting of hard surfaces should enhance both the stain removal and antimicrobial efficacy of these formulations.

Figure 2B:
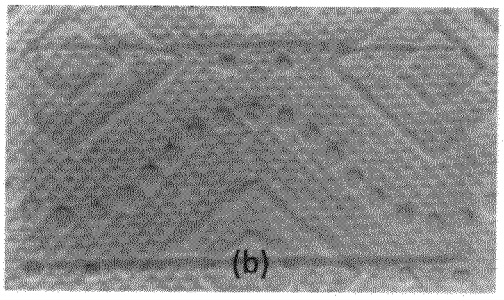
Figure 2C:
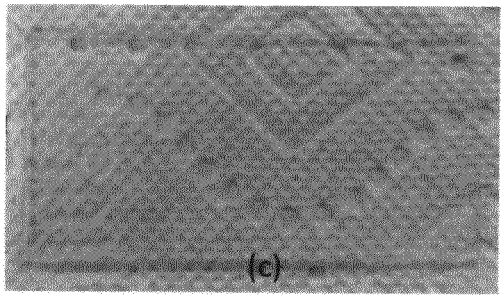

FIGS. 2A-2C show wetting of a glass slide with a paper towel background, 30 seconds after the application of the same diluted 8.25% hypochlorite formulations as described above, containing: no poly(DADMAC) (FIG. 2A), 20 mM poly(DADMAC) (FIG. 2B) and 50 mM poly(DADMAC) (FIG. 2C), respectively. The poorer wetting of the glass slide by the solution in FIG. 2A is indicated by the darker grey color in areas with the thicker layer of liquid, as opposed to the very even wetting of the entire glass slide in FIGS. 2B and 2C.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A composition consisting of:

(a) a homopolymer of diallyl dimethyl ammonium chloride ("DADMAC");

(b) an oxidant selected from the group consisting of a hypohalous acid, a hypohalite, and mixtures thereof;

(c) water; and (d) optionally, an adjuvant selected from the group consisting of a fragrance, a hydrotrope, a colorant, a dye, a buffer, a chelating agent, an electrolyte, an anti-microbial agent, a solvent, a stain and soil repellent, a lubricant, an odor control agent, a perfume, a fragrance release agent, an acid, a base, a solubilizing material, a stabilizer, an anti-corrosion agent, a thickener, a defoamer, a cloud-point modifier, a preservative, a water immiscible solvent, an enzyme, and mixtures thereof;

(e) wherein the composition is free of anionic water-soluble polymers, random copolymers, block copolymers, coacervates, precipitates, and silicone copolymers;

(f) wherein the composition does not form a polyelectrolyte complex; and (g) wherein the pH is between 11.6 and 12.2.

2. The composition of claim 1, wherein the adjuvant comprises a base.

3. The composition of claim 1, wherein the adjuvant comprises a buffer.

4. The composition of claim 1, wherein the adjuvant comprises a fragrance.

5. The composition of claim 1, wherein the adjuvant comprises a hydrotrope.

6. The composition of claim 1, wherein the adjuvant comprises a chelating agent.

7. The composition of claim 1, wherein the adjuvant comprises an anti-corrosion agent.

8. The composition of claim 1, wherein the adjuvant comprises a thickener.

9. The composition of claim 1, wherein the adjuvant comprises a colorant.

10. A composition consisting of:

(a) a homopolymer of diallyl dimethyl ammonium chloride ("DADMAC");

(b) 6.6% to 10.5% of an oxidant selected from the group consisting of a hypohalous acid, a hypohalite, and mixtures thereof;

(c) water; and (d) optionally, an adjuvant selected from the group consisting of a fragrance, a hydrotrope, a colorant, a dye, a buffer, a chelating agent, an electrolyte, an anti-microbial agent, a solvent, a stain and soil repellent, a lubricant, an odor control agent, a perfume, a fragrance release agent, an acid, a base, a solubilizing material, a stabilizer, an anti-corrosion agent, a thickener, a defoamer, a cloud-point modifier, a preservative, a water immiscible solvent, an enzyme, and mixtures thereof;

(e) wherein the composition is free of anionic water-soluble polymers, random copolymers, block copolymers, coacervates, precipitates, and silicone copolymers; and (f) wherein the composition does not form a polyelectrolyte complex.

11. The composition of claim 10, wherein the adjuvant comprises a base.

12. The composition of claim 10, wherein the adjuvant comprises a buffer.

13. The composition of claim 10, wherein the adjuvant comprises a fragrance.

14. The composition of claim 10, wherein the adjuvant comprises a hydrotrope.

15. The composition of claim 10, wherein the adjuvant comprises a chelating agent.

16. The composition of claim 10, wherein the adjuvant comprises an anti-corrosion agent.

17. The composition of claim 10, wherein the adjuvant comprises a thickener.

18. The composition of claim 10, wherein the adjuvant comprises a colorant.

* * * * *